US006623162B2

(12) United States Patent
Pang

(10) Patent No.: US 6,623,162 B2
(45) Date of Patent: Sep. 23, 2003

(54) BLOCK BOTTOM BAG

(75) Inventor: Yuming Pang, Portland, OR (US)

(73) Assignee: Standard Multiwall Bag Manufacturing Co., Beaverton, OR (US)

( * ) Notice: Subject to any disclaimer, the term of this patent is extended or adjusted under 35 U.S.C. 154(b) by 0 days.

(21) Appl. No.: 10/071,758

(22) Filed: Feb. 6, 2002

(65) Prior Publication Data

US 2003/0147567 A1 Aug. 7, 2003

(51) Int. Cl.[7] ..... B65D 30/08; B65D 30/18
(52) U.S. Cl. ..... 383/113; 383/126
(58) Field of Search ..... 383/113, 125, 383/126, 44, 53

(56) References Cited

U.S. PATENT DOCUMENTS 2,176,499 A * 10/1939 Hoppe et al. ..... 383/53
2,968,432 A * 1/1961 Craighead ..... 383/54
3,412,925 A * 11/1968 Booth et al. ..... 383/113
3,776,451 A * 12/1973 Goodrich et al. ..... 383/85
5,553,943 A 9/1996 Cook et al.
6,074,095 A 6/2000 Bannister et al.
6,126,316 A 10/2000 Bannister

FOREIGN PATENT DOCUMENTS

FR 1292332 * 3/1962 ..... 383/125
GB 0880250 * 10/1961 ..... 383/125

* cited by examiner

*Primary Examiner*—Jes F. Pascua
(74) *Attorney, Agent, or Firm*—Ipsolon LLP

(57) ABSTRACT

A block bottom bulk material bag, or satchel bottom bag, is formed from multiple plies of paper and an inner ply of plastic that is adhered to the innermost ply of paper. The bag is formed from roll-stock material that is cut into blanks. The knives that cut the blanks are registered relative to one another so that when the pinch bottom or satchel bottom is formed there is no paper surface exposed to the interior of the bag and the entire interior surface of the bag to which bulk material contained in the bag is exposed is covered with plastic.

15 Claims, 4 Drawing Sheets

Fig. 3 *(PRIOR ART)*
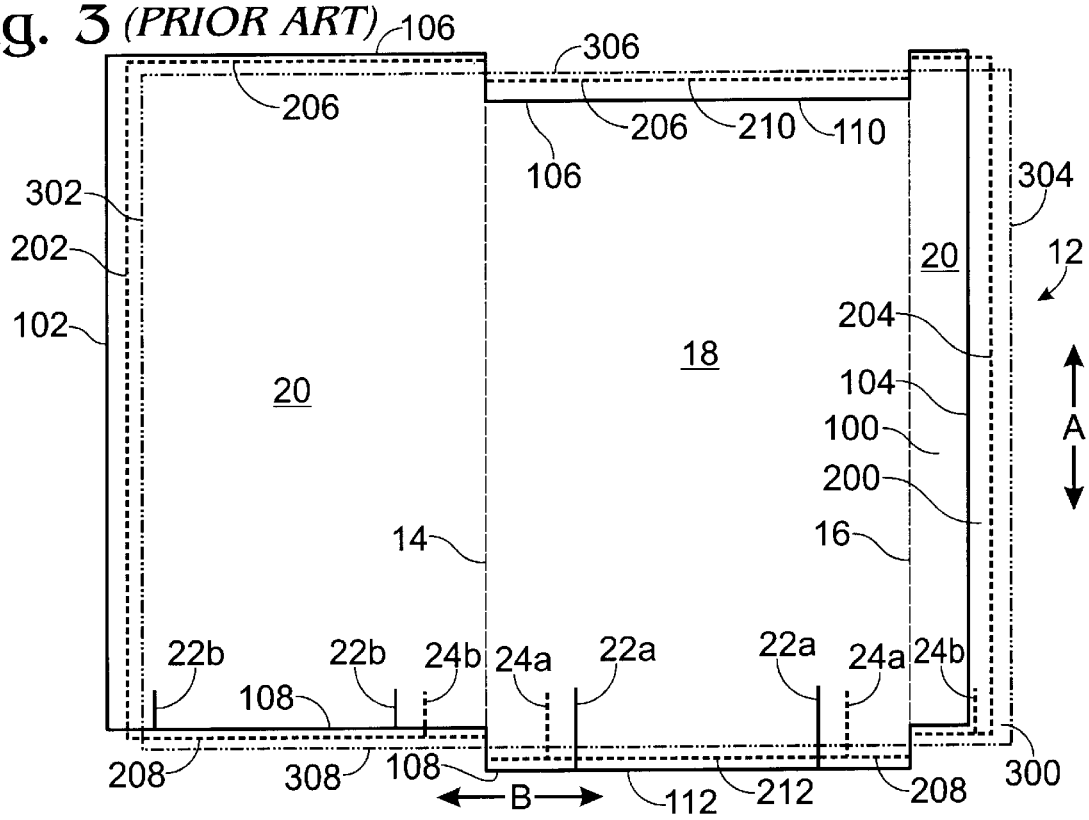
Fig. 4
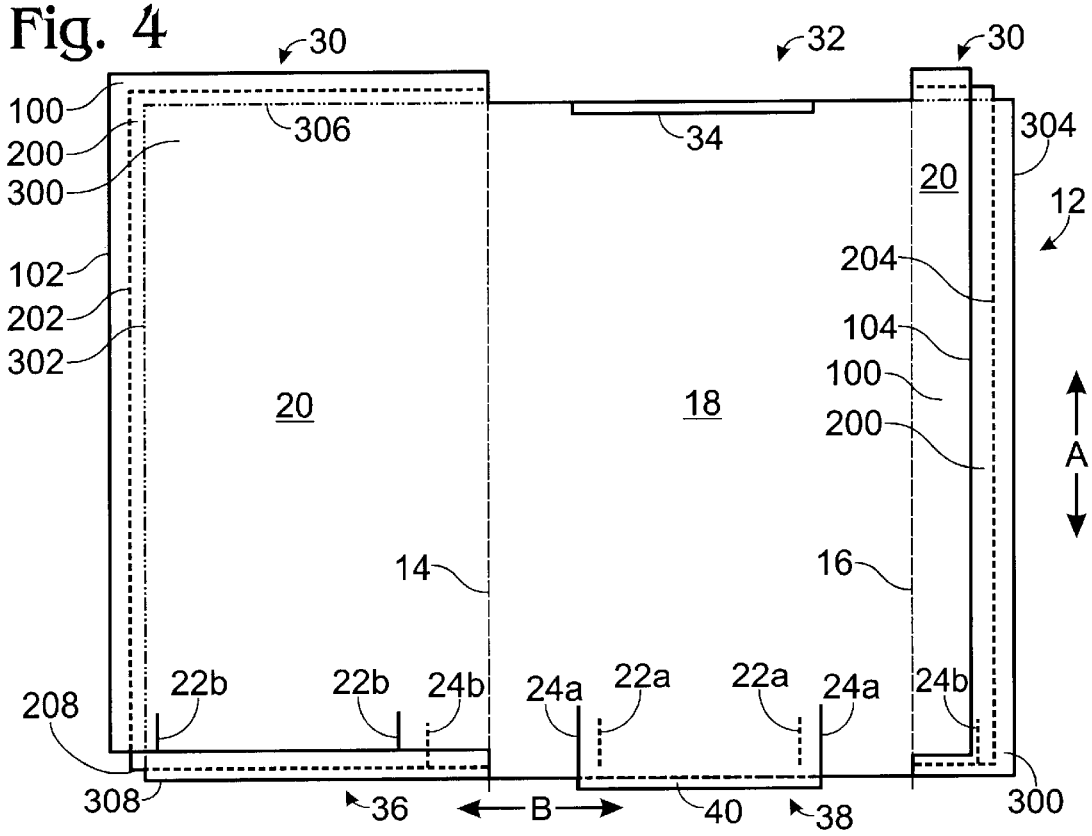

BLOCK BOTTOM BAG

FIELD OF THE INVENTION

This invention relates to multiwall bags of the type commonly referred to as "block bottom bags," and more specifically, to such a bag designed so that the entire interior surface area of the bag that is exposed to product contained in the bag is covered with a plastic liner.

BACKGROUND

Block bottom bags, which are also commonly called "satchel bottom" bags are very useful for holding bulk quantities of material and as such are used ubiquitously in numerous industries. While there are numerous names that are used to describe the bag, they are characterized as having multiple paper plies and a plastic liner, typically polyethylene, and a folded block bottom that is flat when the bag is filled. The open top end of such bags may be closed in several ways, for example by folding it over and "pinching" it shut to seal the bag. When the open end of such bags is closed with a pinched seal the bag is called a "pinch block bottom bag."

Block bottom bags are manufactured from roll stock paper—typically a standard kraft paper, and roll stock polyethylene sheet material. Although there are several well-known processes according to which the bags may be made, briefly described, the bags are fabricated by laminating or gluing a polyethylene layer to an innermost layer of paper. Several additional layers of paper, some of which have been cut and scored by knife blades, are then bonded (as by gluing) to the inner paper layer. Each layer of paper and the plastic layer are "stepped" or laterally offset relative to the next adjacent layer as they are laid down to produce a continuous sheet of a flattened material that typically has three or more layers of paper, and a layer of plastic. Rotating knife blades cut perforations in the blank prior to forming the blank into a tube. The blades are registered relative to one another to produce a stepped pattern for each of the layers in the longitudinal direction. The tube is then bottomed, which is the step in the process where the block bottom is formed and the bottom of the individual bags are closed and sealed. The bottoming process involves tucking or folding the sides of the bag inwardly and closing and gluing the bottom flaps over the folded-in sides. The opposite end of the individual bags are left open, to be closed and sealed later by, for example, the customer after filling. For ease of reference herein, block bottom bags are referred to as BB bags.

After the block bottom is formed, the open end of BB bags may be sealed according to several known processes, for example by folding over the top layers and heat-sealing the plastic liner to the outer ply of paper. Other process steps may often be used as well, for example, printing the outer surface of the outer layer of paper with various information such as the identity of the product that will be held in the bag, the manufacturer of the product, and the net weight of the bag.

BB bags offer numerous advantages. These include that the empty bags are flat and many empty bags may be stacked into a relatively small space. This reduces the costs of shipping many empty bags from the manufacturer to the user. The bags are well suited to holding bulk dry materials such as granulated products. The bags are easily filled, and once filled are easily sealed. Once sealed, the bags are strong and typically avoid sifting or leakage, although many conventional BB bags advantageously allow for some migration of air into and out of the sealed bag. Moreover, filled bags have a squared bottom and flat non-gusseted sides that makes the bags particularly suitable for stacking when filled. As such, the filled bags are easily layered in stable stacks on pallets. And in addition to the advantages just described, BB bags are quite economical to manufacture and use compared to other known bulk bags.

But despite the many advantages of BB bags, there are also several problems. One complaint is that conventional BB bags have sharp corners in the bottom area that may be prone to puncture and other damage caused by impact. One solution to this problem is offered in U.S. Pat. No. 5,553,943, which discloses a BB bag that includes forming a sealed bottom end of the plastic liner that is freely detachable from the paper plies. This construction provides a bag that is air-tight when filled and sealed, and is said to avoid problems caused by the sharp corners found in standard BB bags. However, while the bag disclosed in the '943 patent is useful in many instances, it is not appropriate for use in all situations where bulk materials need to be packaged. For example, in some situations an airtight bag is not desired. Also, the inner plastic liner in a bag such as that described in the '943 patent may not conform to the shape of the block bottom when the bag is formed and filled. This can result in the bag not standing upright during processing between the filling station and the next operation. Since most filling operations are highly automated, such bag handling failure can be a significant problem. Moreover, the bag of the '943 patent may be more expensive to manufacture and may require specialized equipment compared to conventional BB bags.

Another, more significant problem inherent in conventional BB bags has to do with paper that remains exposed to the interior of the bags, and thus to the product contained in the bag. Because as noted BB bags are manufactured with the paper laid down in stepped fashion, when the bottom of conventional bags is formed, there are necessarily two relatively small tabs of paper that remain exposed on the interior of the bag. Stated in another way, owing to manufacturing constraints in making a conventional stepped bag, there are two small tabs of paper on the interior bottom of the bag that are not covered with the polyethylene liner, thus exposing paper to the interior of the bag.

This structural characteristic of conventional BB bags is known to cause several problems. First, when the bags are used for agricultural commodities, exposure of the commodity to paper is a concern with regard to contamination. The polyethylene sheet material that is used to line BB bags is less prone to contamination, such as bacterial contamination than paper. It is undesirable to have an agricultural product exposed to paper that typically is not sterilized.

Further, paper can absorb oils and other fluid components that might be present in the dry bulk products, while polyethylene typically will not absorb oils and other fluids. Absorption of oils and the like from the product into the paper can result in damage to the bag and damage to the product.

Accordingly, in view of the shortcomings inherent in conventional BB bags, there is an opportunity to supply a bag that has all of the advantages of conventional bags, yet avoids the shortcomings.

The illustrated embodiment of the present invention is just such a bag. Most significantly, the bag of is constructed in a manner that it eliminates the paper tabs exposed to the interior of the bag that are notorious in conventional BB bags. Product contained in a bag constructed according to the present invention is exposed to only the polyethylene liner and does not touch the paper plies. This provides substantial advantages from a product quality perspective and may improve sanitation of the product contained in the bag. The bag is equally as economical to manufacture as prior conventional BB bags, and may be manufactured with standard equipment used to make conventional bags, with appropriate modifications.

The bag of the present invention is constructed with multiple plies of paper such as kraft paper that are glued together and stepped relative to one another. The layer of kraft that is adjacent what will become the interior of the bag has a layer of plastic laminated onto it.

The bag is formed from a planar, multi-layer sheet of blank material. Each layer in the blank is stepped in the lateral or cross-bag direction. The layers are also stepped in some portions of the bag in the longitudinal direction. The knives that cut the continuous multi-layer material into individual planar blanks from which the individual bags are formed have been modified so that the knife registry creates specific offset or step patterns in the longitudinal direction. As a result of the offset or stepped pattern in the blanks, when the block bottom is formed in the bag, only plastic liner is exposed to the interior. A special step formed in the bag prevents leakage or "sifting."

BRIEF DESCRIPTION OF THE DRAWINGS

The invention will be better understood and its numerous objects and advantages will be apparent by reference to the following detailed description of the invention when taken in conjunction with the following drawings.

FIGS. 1, 2 and 3 show a conventional BB bag constructed and formed according to the prior art.

FIG. 1 is a perspective view of a prior art BB with the block bottom formed and the upper portions of the bag removed to expose the interior bottom of the bag, and illustrating the paper tabs that are exposed in prior art bags.

FIG. 2 illustrates a prior art BB bag folding in a flat condition, and in which the bottom has been fully formed and the flaps glued in place.

FIG. 3 is a plan view of an unformed multi-wall BB blank formed according to the prior art, before the blank is formed into a tube.

FIGS. 4 through 13 illustrate the BB bag of the present invention.

FIG. 4 is a plan view of an unformed multi-wall BB blank formed in accordance with the present invention, illustrating the blank before it has been formed into a tube and before the block bottom has been formed.

FIG. 5 is a view of a bag according to the present invention, formed from the blank illustrated in FIG. 4, and folded in a flat condition.

FIG. 6 is a cross sectional view taken along the line 6—6 of FIG. 5, illustrating the layers of the bag in exaggerated thickness and showing the overlapping layers forming seams.

FIGS. 7 through 12 are a sequential series of front elevational views that show the steps in the formation of the block bottom.

FIG. 7 shows a formed tube that is open at both ends and is ready for having the block bottom formed.

FIG. 8 is a view of the formed tube of FIG. 7, illustrating the main cross—bag score or fold line and two diagonal fold lines formed in the tube.

FIG. 9 is the next sequential step and illustrates the plies at one side of the tube folded upwardly toward the top of the bag at the main cross bag fold line, defining the upper and lower flaps of the block bottom, the bag corners tucked inwardly, and exposing the four diagonal fold lines and two secondary fold lines;

FIG. 10 illustrates the bag of the present invention in the condition shown in FIG. 9, adding to that view the adhesive applied to various portions of the flaps (adhesive shown in stippling).

FIG. 11 shows the lower flap folded over onto itself at the secondary fold line and adhered to the bottom of the bag.

FIG. 12 is the final step in the sequence, illustrating the upper flap folded over onto itself at the secondary fold line and adhered to the bottom of the bag to complete the formation of the block bottom.

FIG. 13 is a perspective view of a bag according to the present invention with the block bottom formed and the upper portions of the bag removed to expose the interior bottom of the bag, and illustrating the absence of exposed paper.

DETAILED DESCRIPTION OF THE PREFERRED EMBODIMENTS

Figure 1:
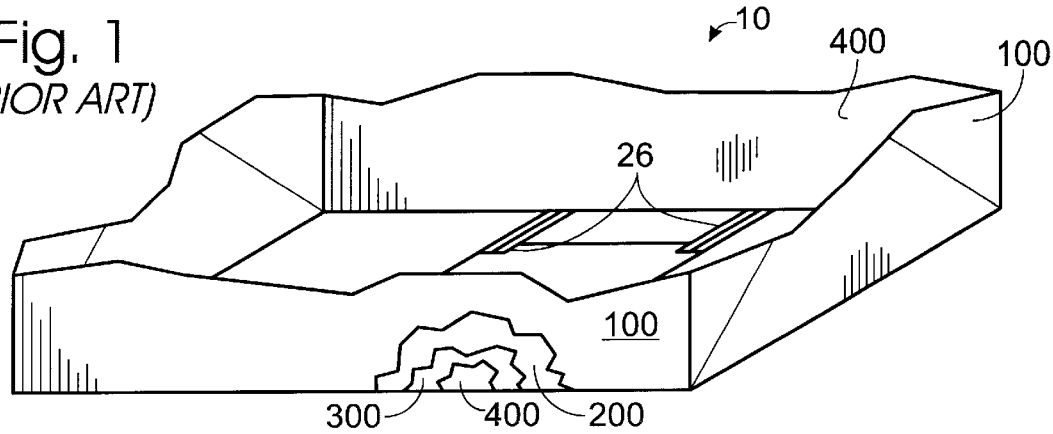
Fig. 1 (PRIOR ART)

The BB bag of the present invention is fabricated from multiple layers of kraft paper, the innermost layer of which (when the bag is formed) is laminated to the adjacent layer of plastic that lines the interior of the bag. In some of the drawing figures, the edges of the various paper plies are shown with line styles that are intended to differentiate the layers. Thus, with reference for example to FIG. 3, the edges of the outermost or external layer of kraft ("outermost" meaning the outer or external layer in the finished bag) are shown with a solid line. The edges of the middle ply of kraft are illustrated with a regular dashed line. And, the edges of the innermost ply are shown with a line comprising dashes separated by two dots. In a drawing that uses this line convention, where the edges of two or more layers are coextensive, the line is shown as solid. To aid in clarity, reference numbers in the 100 series are used to identify structural elements and the like associated with the outermost kraft ply. Reference numbers in the 200 series are used to identify structural elements in the next adjacent ply, and numbers in the 300 series are used to identify structural elements in the third, or innermost kraft layer. Finally, also for the purposes of clarity, like reference numerals are used throughout the specification to identify the same element in various figures.

Although the bag of the present invention is disclosed in terms of a preferred embodiment in which the bag has four plies (three plies of paper and an inner ply of plastic), the principals of the invention as claimed are applicable to BB bags having both greater and fewer plies. As such, the number of plies described herein is not a limitation of the invention.

Prior Art

Figure 2:
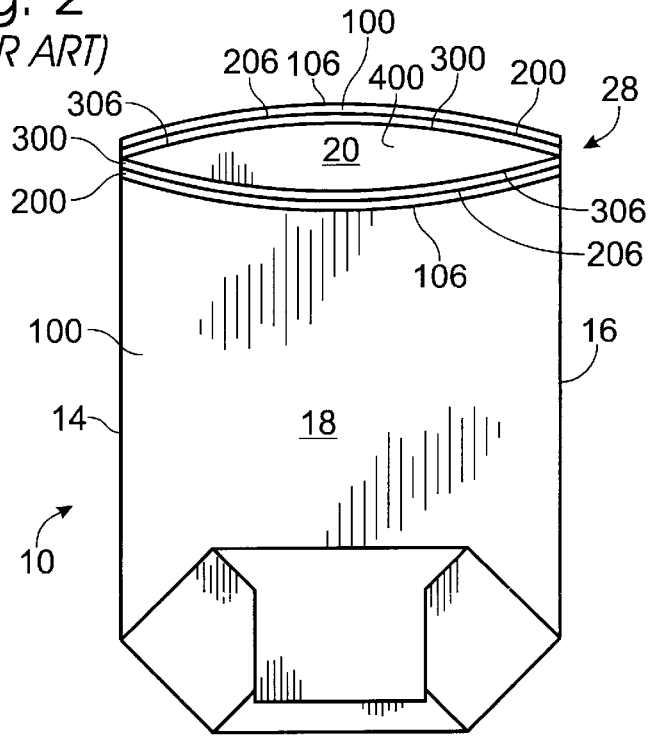
Fig. 2 (PRIOR ART)

A conventional prior art BB bag 10 is shown in FIGS. 1 through 3. With reference to FIG. 1, the outermost layer, also called a ply, (typically kraft paper) 100 is glued to an adjacent middle ply 200, again typically kraft. Middle ply 200 is likewise glued to an inner ply 300 (kraft). Inner ply 300 has a sheet of plastic 400 glued thereto. Plastic ply 400 is typically a polyethylene material, but those skilled in the art recognize that there are many materials available suitable as liner material, and the selection of the material used for the liner will depend upon numerous variables, including for example the nature of the material to be held in the bag, the environmental conditions the bag will be exposed to, and the like.

Figure 6:
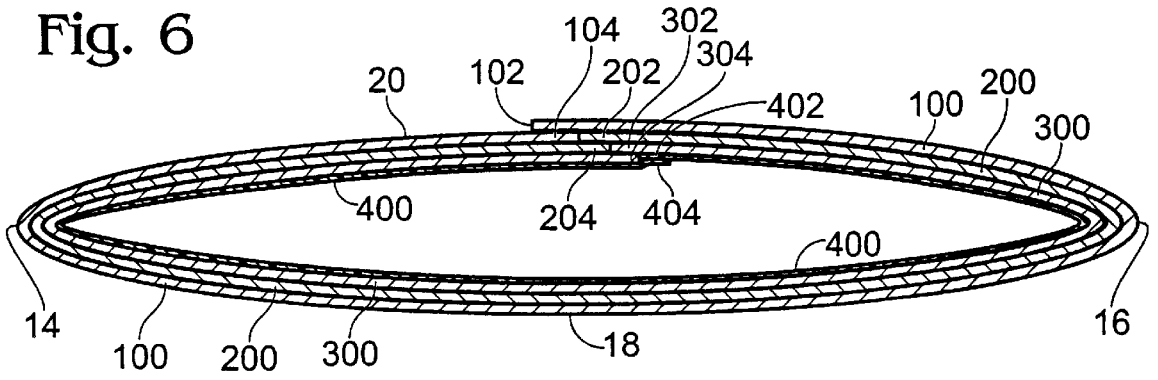

During formation of the blank from which the finished bag will be formed, each layer or ply in bag 10 is laterally stepped or offset relative to the next adjacent layer, as best illustrated the cross sectional illustration of FIG. 6, so that when a tube is formed from the blank the overlapping edges of each layer form a longitudinal seam that is laterally offset from the seam in the next adjacent layer. It should be noted that the bag according to the present invention is identical to the prior art bag with respect to the cross sectional configuration shown in FIG. 6. Therefore, referring specifically to FIG. 6, it may be seen that outer lateral edge 102 of outer layer 100 overlaps with the opposite outer lateral edge 104 of the same layer. In the same way, the outer lateral edge 202 of middle layer 200 overlaps with the opposite outer lateral edge 204. Outer lateral edge 302 of inner layer 300 overlaps with outer lateral edge 304, and the opposite lateral edges 402 and 404 of plastic ply 400 overlap and are sealed to one another. The opposite edges of each layer are overlapped and a strip of suitable adhesive such as hot melt glue is applied to the overlapped area. As detailed below, as the blank is formed the plastic ply is glued onto the inner facing surface of inner ply 300 with plural lines of adhesive such as hot melt applied between these two plies. As such, plastic ply 400 is laminated to inner layer 300 over the entire surface of the plastic ply that contacts layer 300. Plastic ply 400 is laterally offset from inner ply 300 in the same manner described above with respect to the other layers as shown in FIG. 6.

Referring to FIG. 3, a single blank 12 formed according to the prior art is illustrated in a planar condition prior to its being formed into a tube. For reference purposes, the bag axis is defined as the axis extending in the direction of arrow A—that is, the axis that extends along the longitudinal axis of the formed bag. The cross-bag axis is transverse to the bag axis, and is illustrated with arrow B. It will be appreciated that continuous roll stock material is used to form a continuous sheet of multi-layer blank in which the kraft layers are glued to one another and the plastic ply is laminated to the inner layer of kraft as described above. As the roll stock is laid down, each ply is shifted along the longitudinal or bag axis relative to the adjacent layer or layers, creating a stepped pattern in along the cross-bag axis. The layers of kraft are glued to one another such that they are laterally offset or stepped relative to the next adjacent ply. As shown in FIG. 3, the opposite lateral edges 102 and 104 of outer ply 100 are laterally offset from the opposite lateral edges 202 and 204 of the adjacent kraft ply, middle ply 200, and so on. Plastic ply 400 is not shown in FIG. 3 so that the other layers may be shown more clearly. Nonetheless, as noted, it is laterally offset from the inner layer of paper 300

The layers comprising bag 10 are also longitudinally offset relative to the next adjacent layers along the bag axis. Rotating knives that cut the various layers form these offsets, however, rather than physically shifting or staggering of the layers as they are laid down as described above with respect to the lateral offsets. The knives also cut various cut out segments when forming the blanks. The knives cut each individual layer separately prior to the layers being glued to one another. Again referring to FIG. 3, inner ply 300 is seen as being cut into a regular rectangle having linear edges, that is, opposite lateral edges 302 and 304 are straight and parallel, and top end edge 306 and bottom end edge 308 are straight and parallel. Although not shown in FIG. 3, plastic ply 400 is laminated to the inner facing surface of inner layer 300 with the top and bottom edges of the plastic cut coextensive with top and bottom edges 306 and 308, but with the lateral edges 402 and 404 laterally offset from the lateral edges of adjacent layer 300. Middle ply 200 is cut so that it is offset from inner ply 300 along the bag axis, so that the top edge 206 and bottom edge 208 are stepped from the respective top and bottom edges 306 and 308 of inner layer 300. Moreover, the top end edge 206 of middle ply 200 includes a cut out segment 210 that extends between longitudinally extending fold lines 14 and 16, each of which extends along the length of blank 12 along the bag axis. It will be appreciated that because the cut out segment 210 is cut with a rotating knife as the blank material is conveyed past the knife, forming the cut out segment 210 necessarily forms a complementary extended section 212 that extends between fold lines 14 and 16 at the opposite or bottom end of the blank. Finally, outer ply 100 is cut such that it is offset along the bag axis from middle ply 200. Thus, top end edge 106 is offset from edge 206, and bottom edge 108 is offset from bottom edge 208. As with middle ply 200, outer ply 100 has a cut out segment 110 that extends between fold lines 14 and 16, and a complementary extended section 112 that extends across the same distance. In the prior art bag shown in FIG. 3, the top end edges 106, 206 and 306, and the bottom end edges 108, 208 and 308 are longitudinally offset from one another across the entire width of the bag, including in the portion of the bag between fold lines 14 and 16.

Fold lines 14 and 16 define the front panel of bag 10, which in FIG. 3 is identified with reference number 18, and the back panel of the bag, labeled with reference number 20. It will be noted that the back panel is divided into two sections, one on either side of front panel 18, and that the stepped pattern in the various plies is the same on all parts of the back panel so that when the blank is folded along fold lines 14 and 16 to form a tube, the back panel sections at opposite sides of the blank are overlapped and sealed.

Prior to forming blank 12 into a tube, slits 22*a* are cut through outer ply 100 on the front panel 18 of the blank. Parallel slits 24*a* are cut through middle ply 200 outwardly of slits 22*a* on the front panel. Slits 24*a* are slightly shorter than slits 22, and there is no slit in the inner ply 300 or in plastic ply 400.

Similarly, slits 22*b* are cut through outer ply 100 on back panel 20 (which as noted above is divided into two sections, one on either side of the front panel), and parallel slits 24*b* are cut through middle ply 200 on the back panel. Slits 24*b* are slightly longer than slits 22*b*. All of the slits are cut through the adjacent bottom edge of the respective ply, as illustrated.

The purpose of the slits 22 and 24 is detailed below in respect of the preferred embodiment. It will be noted that the slits in each preceding overlying ply are sequentially shorter than the slits in the adjacent ply.

Blank 12 is formed into a tube and the block bottom is formed (in a manner detailed below) to form an empty bag 10 as shown in FIG. 2. To form the blank into a blank tube, it will be appreciated that the flat or planar blank 12 is folded along fold lines 14 and 16, which form the lateral side edges of bag 12 in FIG. 2 and the outer lateral edges of the two portions of back panel 20 (i.e., located on opposite sides of front panel 18 in the flat blank shown in FIG. 3) are overlapped and glued as described above. As a result of the cut out segments 110 and 210, the upper edges of the outer, middle and inner plies 106, 206 and 306, respectively, define an upwardly extending flap 28 on the back side 20 of the bag. Flap 28 may be folded over the upper edges 106, 206 and 306 on the front panel 18 of the bag after it is filled to seal the upper open mouth of the bag. The flap is typically heat sealed to close the bag, although other types of seals are commonly used.

Referring now to FIG. 1, the bottom portion of a prior art bag 10 that has been formed from a blank 12 as shown in FIG. 3 is illustrated. Importantly, owing to the manner in which blank 12 is formed, when the block bottom of bag 10 is formed and the bag bottom is folded over and sealed, two strips of paper 26 are exposed to the interior of the bag. Said in another way, with the prior art bag shown in FIG. 1, plastic ply 400 does not cover the two strips identified with number 26, and as such, these strips are uncoated kraft paper. For the reasons described above, these uncoated paper strips are undesirable.

Preferred Embodiment of the Invention

The preferred embodiment of the present invention will now be described with reference to FIGS. 4 through 12. A blank 12 similar to the blank 12 that is described above with respect to FIG. 3, but embodying the present invention, is shown in FIG. 4. Blank 12 is a planar sheet that comprises three layers or plies of paper and an innermost layer of plastic. The plastic layer is laminated onto the layer of paper that will become the innermost layer in the formed bag. The plastic is glued to the innermost layer of paper over substantially the entire surface of the plastic layer and the plastic layer is therefore non-detachable from the innermost paper layer. This is preferably accomplished by laying down plural strips of adhesive along the bag axis on the innermost paper ply and adhering the plastic thereto. As noted above, the plastic (which is not shown in FIG. 4) is laterally stepped relative to the next adjacent layer of paper so that when the tubular bag is formed the opposite lateral edges of the plastic are overlapped and sealed to form a seam (FIG. 6). Because the plastic is adhered to the paper over the entire surface of the plastic, the plastic is inseparable from the inner layer of paper so that when the block bottom is formed, the plastic layer conforms to the shape and folds of the paper layers.

Referring to FIG. 4, a single blank 12 formed according to the present invention is illustrated prior to its being formed into a tube. The bag axis is the axis extending in the direction of arrow A—that is, the axis that extends along the longitudinal axis of the formed bag. The cross-bag axis is transverse to the bag axis, and is illustrated with arrow B.

Roll stock material is used to form a continuous sheet of multi-layer blank in which the layers of paper are glued to one another and the plastic ply is laminated to the inner layer of kraft as described above. The layers of kraft are glued to one another such that they are laterally offset from one another along the cross-bag axis, as shown. The opposite lateral edges 102 and 104 of outer ply 100 are laterally offset from the opposite lateral edges 202 and 204 of the adjacent kraft ply, middle ply 200, and so on.

The blank 12 and thus bag 10 according to the present invention differs from the blank and bag formed according to the prior art in the manner that rotating knives that cut the continuous sheets of planar roll stock paper that form the blank are registered with respect to one another, and thus the manner in which the blank and block bottom are formed.

With continuing reference to FIG. 4, longitudinal fold lines 14 and 16 extend along the length of the bag along the bag axis and define a front panel 18 and a rear panel 20. The top edge 30 of blank 12 on rear panel 20 is cut with rotating knives so that thee three layers of paper (100, 200 and 300) are stepped relative to one another along the bag axis as shown. The identical stepping pattern is formed on rear panel 20 on the opposite side of fold line 16 at top edge 30. The top edge 32 of front panel 18 (that is, the top edge of the blank between fold lines 14 and 16) is cut such that all three layers of paper and the plastic are coextensive—that is, the edges are co-linear, except at a cut out step segment 34 that is cut from the outer ply 300. The function of step segment 34 is detailed below.

Turning to the bottom edge of the blank 12 of FIG. 4, the three layers of paper are stepped relative to one anther at bottom edge 36 of rear panel 20 in a complementary manner to the top edge 30. Bottom edges 108, 208 and 308 are thus stepped in the longitudinal direction along the bag axis as illustrated. The paper layers at the bottom edge 38 of front panel 18 are, however, cut such that they are coextensive and the edges are co-linear, except for the extended step segment 40 of outer ply 100 that is complementary to and a result of step segment 34 cut into ply 100 at top edge 32.

As with the blank shown in FIG. 3, in the blank 12 of the present invention, ply 300 is seen as being cut into a regular rectangle having linear edges, that is, opposite lateral edges 302 and 304 are straight and parallel, and top end edge 306 and bottom end edge 308 are straight and parallel. The plastic ply 400 (which is not shown in FIG. 4) is laminated to the inner facing surface of inner layer 300 with the top and bottom edges of the plastic cut coextensive with top and bottom end edges 306 and 308, but with the lateral edges offset from the adjacent layer.

Prior to forming the flattened blank 12 into a tube, slits are cut in the blank in the manner described above with respect to FIG. 3. Specifically, slits 22*a* are cut through outer ply 100 on the front panel 18, and parallel slits 24*a* are cut through middle ply 200 outwardly of slits 22*a* on the front panel. Slits 24*a* are slightly shorter than slits 22, and there is no slit in the inner ply 300 or in plastic ply 400. Slits 22*b* are cut through outer ply 100 on back panel 20 and parallel slits 24*b* are cut through middle ply 200 on the back panel. Slits 24*b* are slightly longer than slits 22*b*.

The next step in forming a finished bag is forming a tubular blank that has open top and bottom ends from the planar blank shown in FIG. 4. This is done in a standard manner by folding blank 12 along fold lines 14 and 16 such that the opposite lateral edges overlap as illustrated in FIG. 6 and as described above. The overlapping lateral edges are sealed as described above to form the tubular blank.

Figures 7, 8, 9, 10, 11, 12:
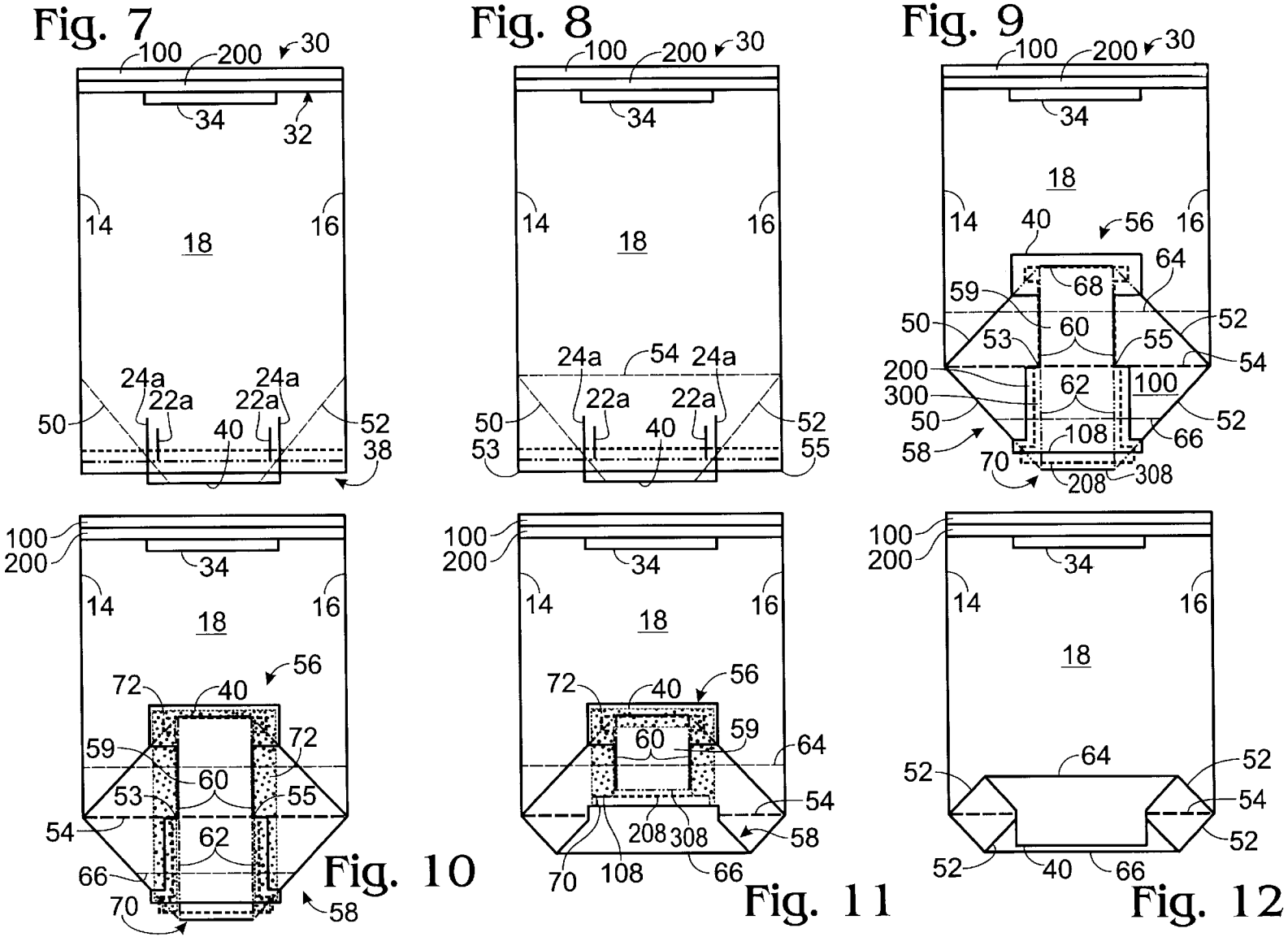

The closed block bottom is formed next, and is explained herein with reference to the sequence of illustrations beginning with FIG. 7 and continuing through FIG. 12. With reference to FIG. 7, the tubular blank is shown in a flat condition with front panel 18 facing the viewer and with fold lines 14 and 16 shown as defining the opposite lateral edges of the flattened tube. When the tube is formed as shown, slits 22 and 24 in the respective front and back panels (18 and 20) are aligned with one another. Diagonal fold lines 50 and 52 are formed by creasing the tube to facilitate folding. The fold lines extend from the respective lateral edges of the flattened tube and extend to the stepped segment 34 along bottom edge 38. A primary cross-bag fold line 54 is next formed laterally across the tube, transverse to the bag axis, and extending between the points where diagonal fold lines 50 and 52 intersect the respective lateral edges of the tube (FIG. 8). Fold lines 50, 52 and 54 are formed in all plies of the tube. The lower lateral corners of the flattened tube shown in FIG. 8 are referred to with reference numbers 53 and 55, respectively.

Turning to FIG. 9, formation of the block bottom of the bag is begun by folding the plies defining the front panel 18 upwardly along fold line 54 and by tucking the sides inwardly along diagonal fold lines 50 and 52. The corners 53 and 55 are thus folded or tucked inwardly toward the longitudinal centerline of the bag, as shown in FIG. 9. The bag thus folded lies essentially flat, and diagonal fold lines 50 and 52 define a front flap in front panel 18, denoted generally with reference number 56, and a back flap in back panel 20, denoted generally with reference number 58—the two flaps 56 and 58 separated by cross-bag fold line 54. Since the flattened blank is tubular, folding the tube in the manner just described leaves an opening denoted with reference number 59 in the bottom of the tube. The opening 59 is defined by the lateral edges 60 of front flap 56, lateral edges 62 of back flap 58, and by upper edge 68 and lower edge 70 of flaps 56 and 58, respectively, and the perimeter of the opening as just noted defines a regular rectangle.

Owing to the manner in which bottom edges 36 and 38 of blank 12 were formed (detailed above with reference to FIG. 4) and the manner in which slits 22 and 24 were cut into the plies (also detailed above), the edges of each layer of material that define lateral edges 60 of front flap 56 are aligned or coextensive with one another. The end edges of the plies of back flap 58 are, in contrast, stepped relative to one another as shown so that plies 100, 200 and 300 are stepped relative to one another. Similarly, and again owing to the manner of forming blank 12 detailed above, the ply edges at upward edge 68 of front flap 56 are coextensive except for the stepped segment 40, whereas the ply edges 108, 208 and 308 at lower edge 70 of back flap 58 are offset from one another.

Secondary cross-bag fold lines 64 and 66 are formed along the cross-bag axis across front flap 56 and back flap 58, respectively. Secondary fold lines 64 and 66 are parallel to one another and to fold line 54, and equally spaced on opposite sides thereof.

The next step in the formation of the block bottom is gluing the various flaps to one another to close opening 59 in such a manner that the interior of the bag thus formed is entirely lined with polyethylene layer 400. Turning to FIG. 10, adhesive 72 (such as a paste glue or a hot melt glue) is shown by stippled shading. Adhesive 72 is applied to the exposed surfaces of upper and lower flaps 56 and 58 as shown. Specifically, adhesive 72 is applied to front flap 56 along a zone that laterally borders opening 59, and along a complementary zone that borders opening 59 at back flap 58. However, adhesive is not applied along the lower edge 70 of back flap 58. With the adhesive applied as indicated, back flap 58 is folded upwardly along secondary fold line 66 and adhered to the now-facing surface, as illustrated in FIG. 11. The lateral side edges 62 of opening 59 in back flap 58 align with the lateral side edges 60 of front flap 56 in the longitudinal direction (arrow A in FIG. 4) and the lower edge 70 extends just beyond fold line 54. Next, front flap 56 is folded downwardly along secondary fold line 64 over the already-folded-over back flap 58 and is glued to the outer-facing surface of the back flap. This closes opening 59 and seals the opening. Step segment 40 ensures that the seal is complete and leak free. Because the side edges 60 and 62 of the respective flaps are aligned along the longitudinal axis when the flaps 56 and 58 are folded over onto themselves as described, the entire inner-facing surface of the now-formed bag is lined with polyethylene, and there is no exposed paper.

The bag thus formed has an open upper end and is ready for shipment to the end user for filing. The empty bags lie flat and may be efficiently stacked onto pallets and the like for shipping.

Figure 13:
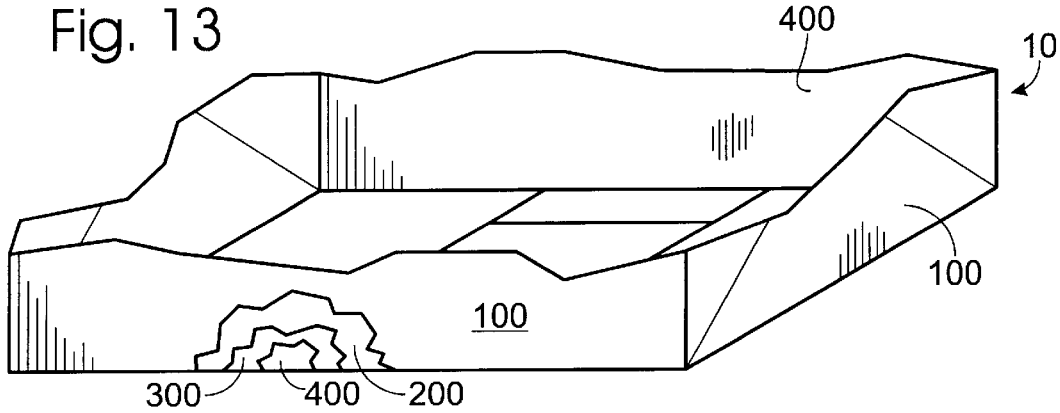
Figure 5:
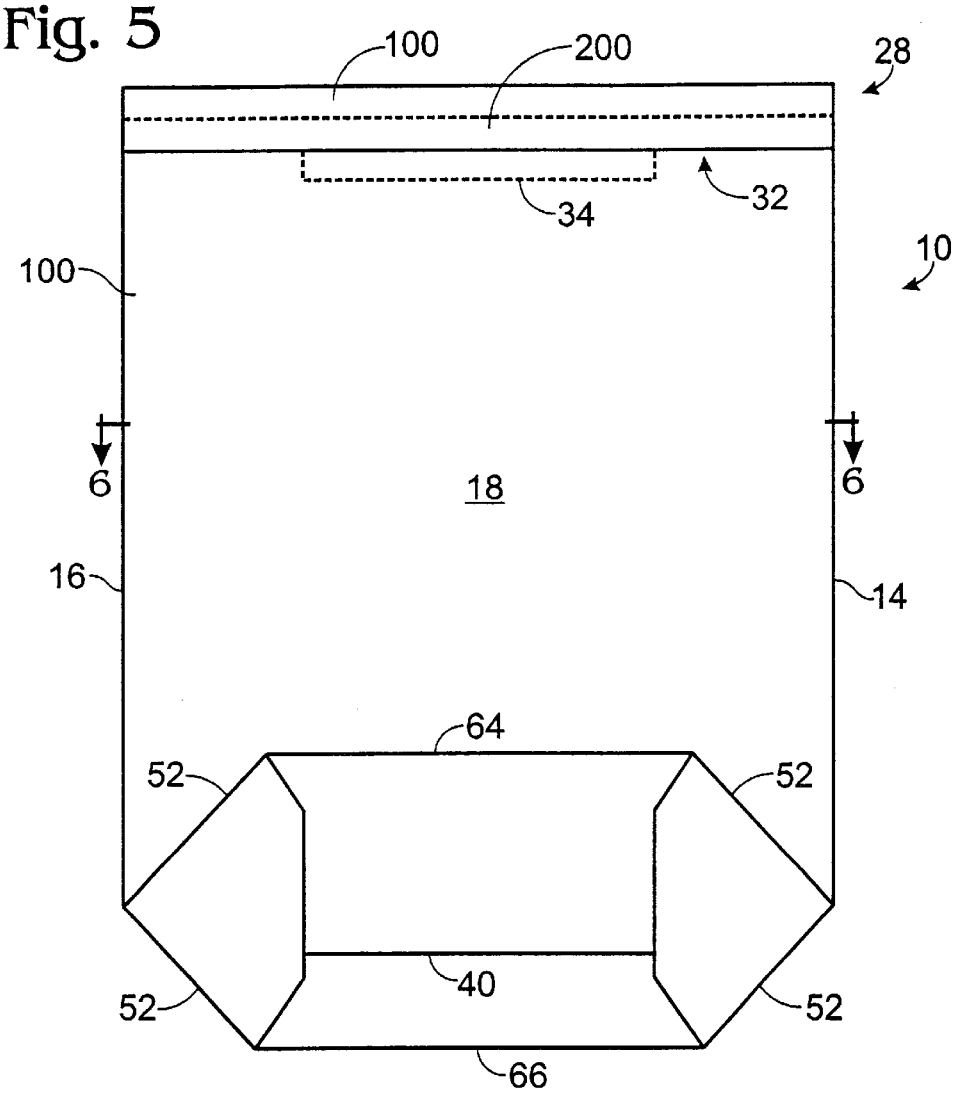

Referring now to FIG. 13, it may be seen that the finished bag of the present invention comprises a tubular body having an open end and a closed end defined by the satchel-fold, also known as satchel bottom, described in detail above. The interior space defined in the bag is free from exposed paper—that is, the entire interior surface of the bag to which bulk material contained in the bag is exposed, is covered with plastic ply 400. This avoids the problems inherent with known BB bags relating to exposed paper in the bag interior.

When a bulk material has been filed into the bag through the open end, the flap 28 (FIG. 5) on back panel 20 is folded over front flap 18 and sealed in place to entirely close and seal the bag.

While the present invention has been described in terms of a preferred embodiment, it will be appreciated by one of ordinary skill that the spirit and scope of the invention is not limited to those embodiments, but extend to the various modifications and equivalents as defined in the appended claims.

I claim:

1. A block bottom bag for containing bulk quantities of material and of the type having one open end and a block bottom closure at the opposite end, comprising:

a tubular body having one open end and a closed block bottom end to define a bag having an interior surface, said body defining a longitudinal bag axis and comprising multiple plies of paper including an innermost paper ply and a ply of plastic glued to said innermost paper ply and non-detachable therefrom, and an outermost paper ply, each of said paper plies having opposite lateral side edges overlapped along the bag axis and adhered to one another to define offset longitudinal seams and said plastic layer having opposite lateral side edges overlapped and sealed, and said body further comprising a front panel and a back panel; and opposite side edges and opposed top and bottom edges to define first and second opposed bottom corners, wherein said open end is defined by the respective top edges of the front and back panels and the top edge of the back panel extends beyond the top edge of the front panel, and in the front panel the outermost paper ply includes an extended segment extending across a portion of the front panel at the bottom edge, and wherein the block bottom end is formed by folding said opposed bottom corners inwardly at a pair of diagonal fold lines to define a front flap and a back flap, each of said diagonal fold lines extending diagonally from a respective side edge to the bottom edge to thereby define an opening at the bottom of said bag, and wherein the perimeter of said opening defines a regular rectangle defined by opposed lateral edges and opposed upper and lower edges, said opening having a front flap portion and a back flap portion, wherein the lateral edges of all paper plies and plastic in the front flap portion opening are coextensive, and the lateral edges of plastic in the back flap portion of the opening are aligned with the lateral edges of the opening in the front flap portion but the edges of at least one paper ply in the back flap portion are stepped laterally outwardly relative to the edges of the plastic in said back flap portion, wherein said interior surface is substantially entirely covered with said plastic and substantially free from exposed paper.

2. The block bottom bag according to claim 1 further including a primary cross bag fold line extending transverse to the longitudinal bag axis and extending between the side edges and intersecting the points where said diagonal fold lines intersect said side edges.

3. The block bottom bag according to claim 2 further including first and second secondary cross bag fold lines, each extending parallel to said primary cross bag fold line and each spaced from said primary cross bag fold line on opposite sides thereof.

4. The block bottom bag according to claim 3 including adhesive applied to zones bordering the opposed lateral edges of the rectangular opening and to a zone bordering the upper edge of said opening.

5. The block bottom bag according to claim 4 wherein the rectangular opening is closed by folding the back flap at said second secondary cross bag fold line and securing it to said adhesive along the zones bordering the opposed lateral edges, and by folding the front flap at said first secondary fold line such that said front flap overlaps said back flap and is secured thereto.

6. The block bottom bag according to claim 5 including an outermost paper layer and wherein said front flap includes an extended segment defined by said outermost paper layer and extending laterally across said front flap.

7. The block bottom bag according to claim 6 wherein said extended segment overlaps and is adhered to said back flap.

8. A blank for forming a bag for containing bulk quantities of material and of the type having one open end and one closed block bottom end, comprising:

multiple paper layers, each layer adhered to the next adjacent layer to define a top paper layer and a bottom paper layer;

at least one plastic layer adhered to the top paper layer and non-detachable therefrom, said plastic layer and said top paper layer having coextensive edges;

said multiple layers of paper and plastic defining a generally rectangular blank having a longitudinal bag axis, wherein each layer of paper and plastic has opposed side edges and opposed top and bottom end edges;

a pair of fold lines extending along said longitudinal bag axis to define a front panel having top and bottom edges and a back panel having top and bottom edges;

wherein in the back panel the top edge of each layer of paper is offset along the longitudinal axis relative to the top edge of the top paper layer and the plastic layer, and in the front panel the bottom layer includes an extended segment of paper that extends laterally across a portion of the front panel at the bottom edge and said extended segment extends beyond the coextensive edges of all other layers in the front panel at the bottom edge.

9. The blank according to claim 8 wherein each side edge of each layer is offset relative to the coextensive side edges of the top paper layer and the plastic layer.

10. The blank according to claim 9 formed into a bag defining a tubular body having an open end and a closed end defined by a block bottom closure, said bag formed by folding said blank at said fold lines and overlapping and adhering to one another the respective side edges of each layer to define offset longitudinal seams, and wherein said closed end defines an inner bag surface that is substantially entirely covered with said plastic and substantially free from exposed paper.

11. A method of forming a bag of the type having one open end and an opposite end of the block bottom closure type, comprising the steps of:

(a) providing a flat and generally rectangular bag blank from multiple paper layers, each layer adhered to the next adjacent layer to define a top layer and a bottom layer and adhering a plastic layer to the top paper layer so that the plastic layer is non-detachable therefrom and has peripheral edges coextensively aligned with said top layer around the entire periphery thereof, said bag blank having opposed side edges and opposed top and bottom end edges and defining a longitudinal bag axis extending between said opposed top and bottom end edges;

(b) scoring the bag blank to form a pair of parallel fold lines extending between said opposed top and bottom end edges to define a front panel and a back panel wherein in the back panel the end edge of each layer of paper is offset along the longitudinal axis relative to the end edge of the top paper layer and the plastic layer, and in the front panel the bottom layer includes an extended segment of paper that extends laterally across a portion of the front panel at the bottom edge and said extended segment extends beyond the coextensive edges of all other layers in the front panel at the bottom edge;

(c) folding said bag blank along said parallel fold lines and overlapping and adhering to one another the respective side edges of each layer to form a tubular member having open opposite ends and having a front panel and a back panel having opposed top corners at a top end of said tubular member and opposed bottom corners at a bottom end of said tubular member;

(d) closing the bottom end of said tubular member to define a block bottom closure by folding said opposed bottom corners inwardly at a pair of diagonal fold lines, each of said diagonal fold lines extending diagonally from a respective side edge to the bag bottom edge to thereby define an opening at the bottom end of said bag, and wherein the perimeter of said opening defines a regular rectangle defined by opposed lateral edges and opposed upper and lower edges of a respective front and back flap, said opening having a front flap portion and a back flap portion, wherein the lateral edges of the paper plies and plastic in the front flap portion are coextensive, and the lateral edges of plastic in the opening in the back flap portion are aligned with the lateral edges of the front flap portion but the edges of at least one paper layer at the opening at the back flap portion are stepped laterally outwardly relative to the edges of the plastic in said back flap portion to define an inner bag surface that is substantially entirely covered with said plastic and substantially free from exposed paper.

12. The method according to claim 11 including the step of forming a primary fold line extending transverse to the bag axis and intersecting said opposed side edges at the points where said diagonal fold lines intersect said opposed side edges.

13. The method according to claim 12 wherein step (d) further comprises forming first and second secondary bag fold lines extending parallel to said primary cross bag fold line and each spaced from said primary fold line on opposite sides thereof.

14. The method according to claim 13 including applying adhesive to zones bordering the opposed lateral edges of the opening.

15. The method according to claim 14 including folding said tubular member at said first and second secondary fold lines to close said opening.

* * * * *